US007684718B2

(12) United States Patent
Kunimori

(10) Patent No.: US 7,684,718 B2
(45) Date of Patent: Mar. 23, 2010

(54) COLOR IMAGE RECORDING APPARATUS FOR DETERMINING A COLOR SHIFT VALUE BETWEEN IMAGE FORMING UNITS

(75) Inventor: Osamu Kunimori, Tokyo (JP)

(73) Assignee: Oki Data Corportion, Tokyo (JP)

( * ) Notice: Subject to any disclaimer, the term of this patent is extended or adjusted under 35 U.S.C. 154(b) by 593 days.

(21) Appl. No.: 11/679,551

(22) Filed: Feb. 27, 2007

(65) Prior Publication Data

US 2007/0223974 A1 Sep. 27, 2007

(30) Foreign Application Priority Data

Mar. 22, 2006 (JP) ..... 2006-078313

(51) Int. Cl.
*G03G 15/00* (2006.01)
*G03G 15/01* (2006.01)

(52) U.S. Cl. ..... 399/49; 399/301

(58) Field of Classification Search ..... 399/40, 399/49, 51, 298, 301, 302, 303; 347/116
See application file for complete search history.

(56) References Cited

U.S. PATENT DOCUMENTS 6,148,168 A * 11/2000 Hirai et al. ..... 399/301
6,198,896 B1 * 3/2001 Nakayasu et al. ..... 399/301
6,219,517 B1 * 4/2001 Takahashi et al. ..... 399/301

(Continued)

FOREIGN PATENT DOCUMENTS

JP 2001-134041 5/2001

(Continued)

*Primary Examiner*—Robert Beatty
(74) *Attorney, Agent, or Firm*—Panitch Schwarze Belisario & Nadel LLP

(57) ABSTRACT

An image recording apparatus capable of correctly determining a color shift value between recording heads of different color. The image recording apparatus has each recording head print two types of patches as patterns on a conveyance belt and has a reflection intensity detection unit read reflection intensities of the two patches to determine the color shift value and correct the color shift value so as not to include a position shift value between a reference position and a position where the actual reading has started. The image recording apparatus for recording a pattern to a color image conveyance medium and reading the recorded pattern comprises a feeding unit that feeds the color image conveyance medium along a feeding path, a first image forming unit that records the pattern to the color image conveyance medium in a first color, a second image forming unit that records the pattern to the color image conveyance medium in a second color, a reflection intensity detection unit that reads a reflection intensity of the pattern, an image formation control unit for calculating from the reflection intensity a color shift value of the second image forming unit with respect to the first image forming unit, wherein the first image forming unit records a first pattern of a first interval and the second image forming unit records a second pattern of a second interval overlapping the first pattern so that a first patch having the first pattern and the second pattern overlapped is formed, and wherein the first image forming unit records a third pattern of the second interval and the second image forming unit records a fourth pattern of the first interval overlapping the third pattern so that a second patch having the first pattern and the second pattern overlapped is formed.

10 Claims, 18 Drawing Sheets

U.S. PATENT DOCUMENTS

| | | | | |
|---|---|---|---|---|
| 6,408,156 | B1 | 6/2002 | Miyazaki et al. | |
| 6,714,748 | B1 * | 3/2004 | Nakayasu et al. | 399/72 |
| 6,915,096 | B2 * | 7/2005 | Taka et al. | 399/301 |
| 7,055,928 | B2 * | 6/2006 | Ishibashi et al. | 347/19 |
| 7,203,433 | B2 * | 4/2007 | Kato et al. | 399/49 |
| 7,257,358 | B2 * | 8/2007 | Overall et al. | 399/301 |
| 7,443,535 | B2 * | 10/2008 | Ishibashi | 358/1.9 |
| 2004/0227966 | A1 * | 11/2004 | Lee | 358/1.9 |
| 2006/0056882 | A1 * | 3/2006 | Kwon et al. | 399/301 |

FOREIGN PATENT DOCUMENTS

| | | | | |
|---|---|---|---|---|
| JP | 2002221842 | A | * | 8/2002 |
| JP | 2005352082 | A | * | 12/2005 |
| JP | 2006078850 | A | * | 3/2006 |

* cited by examiner

COLOR IMAGE RECORDING APPARATUS FOR DETERMINING A COLOR SHIFT VALUE BETWEEN IMAGE FORMING UNITS

BACKGROUND OF THE INVENTION

The present invention relates to an image recording apparatus.

A conventional color image recording apparatus such as, e.g., a color electrophotographic printer has multiple processing units containing recording devices arranged in a line as image formation sections. A tandem color image recording apparatus described in Japanese Patent Application Publication 2001-134041 has four processing units, yellow (Y), magenta (M), cyan (C), and black (K), lined up as each type of image forming unit and sequentially copies toner images onto paper electrostatically held and fed on a conveyance belt. In such a color image recording apparatus, the printing speed can be increased because an image in four colors can be printed during a single feeding of the paper. Especially in a processing unit having a miniature LED head or the like as the recording device, the overall size of the apparatus can be reduced by disposing a line head that is mechanically affixed and combined with an image drum unit serving as the image formation section.

However, in the aforementioned conventional color image recording apparatus, due to the insufficient machining accuracy of the unit parts and the like forming the apparatus and the insufficient accuracy of mounting the recording head to the apparatus, it is difficult to prevent displacement between each recording head and image drum unit, and therefore the printing position cannot be held constant in relation to the printing medium. Thus, where a color image made of sequentially overlapping yellow, magenta, cyan, and black toner images in each line is copied, there arises a problem that the printing position is shifted between each color (color shift). A shift of the recording head in the lateral direction crossing the feeding direction of the conveyance belt causes a color shift in the overlapping colors in a main scanning direction. A shift thereof in the longitudinal direction causes a color shift in a secondary scanning direction. In addition, in a case where the mounting position of each line of the recording head is unevenly inclined in the secondary scanning direction, color shift of the overlapping colors occurs in a direction diagonal to the feeding direction. In the conventional color image recording apparatus, when the mounting position of a printing unit is displaced in a main scanning direction, a secondary scanning direction, or a diagonal direction, a displacement arises in the printing location causing a color shift between each of the colors. In order to detect and correct the color shift, the conventional color image recording apparatus prints a stripe pattern overlappingly on another stripe pattern different in color and in separation distance so as to form a patch.

FIG. 17 shows detection patterns 61 through 64 printed on a color image conveyance medium such as, e.g., a recording medium and the conveyance belt, and color shift detection values 0, −1, +1, and −1 respectively corresponding to the detection patterns 61, 62, 63, and 64. When it is detected that the portion of a detection pattern having lower reflective intensity is shifted to right, it is determined that the color recording head is shifted to downstream on the conveyance belt, i.e., a positive direction, with respect to the black recording head. The detection patterns 61, 62, and 63 show cases where there is no color shift of the color recording head with respect to the black recording head. However, in a case of the detection pattern 62, it is falsely determined that the color recording head is shifted to a negative direction since detection is started before the leading edge of the detection pattern 62 arrives at a reflection intensity detection unit 24.

On the other hand, in a case where detection begins after the leading edge of detection pattern 63 arrives at the reflection intensity detection unit 24, a color shift to a positive direction is falsely determined. In such a color shift detection method, an error arises in the color shift detection value because of variation of a time from when exposure begins for the photosensitive body to when the toner latent image arrives at the reflection intensity detection unit 24. To overcome this deficiency, the overall length of the patch having patterns shifted by a certain amount should be equal to or larger than the amount of shift in reading starting position of the reflection intensity detection unit 24 from a reference position.

The patch in FIG. 18 is made from two detection patterns where separation distances are described in the unit of 25.4/1200 mm=1200 dpi. The overall length of the patch is set to approximately 1.5 nm so as to correctly detect the color shift detection value without being affected by the shift in the reading starting position of the reflection intensity detection unit 24.

With such conventional color shift detection methods, it is necessary to configure the length of the patch having patterns shifted by a certain amount to be equal to or larger than the amount of shift in the reading starting position of the reflection intensity detection unit from the reference position, thus resulting in the drawbacks that the overall length of the patch used for the color shift detection process is lengthened.

BRIEF SUMMARY OF THE INVENTION

In view of the aforementioned problem, it is therefore an object of the present invention to provide an image recording apparatus that can shorten the overall length of the patch for the color shift detection process without the necessity of configuring the length of the patch to correspond to the amount of shift in the reading starting position of the reflection intensity detection unit 24 from the reference position.

This and other objects, features and advantages in accordance with the present invention are provided by the image recording apparatus for recording a pattern to a color image conveyance medium and reading the recorded pattern, the image recording apparatus comprising a feeding unit that feeds the color image conveyance medium along a feeding path, a first image forming unit that records the pattern to the color image conveyance medium in a first color, a second image forming unit that records the pattern to the color image conveyance medium in a second color, a reflection intensity detection unit that reads a reflection intensity of the pattern, an image formation control unit for calculating from the reflection intensity a color shift value of the second image forming unit with respect to the first image forming unit, wherein the first image forming unit records a first pattern of a first interval and the second image forming unit records a second pattern of a second interval overlapping the first pattern so that a first patch having the first pattern and the second pattern overlapped is formed, and wherein the first image forming unit records a third pattern of the second interval and the second image forming unit records a fourth pattern of the first interval overlapping the third pattern so that a second patch having the third pattern and the fourth pattern overlapped is formed.

According to the present invention, the first patch is formed by overlapping the first and second patterns. In the same manner, the second patch is formed as a result of overlapping the third pattern of the second interval formed with the first color and the fourth pattern of the first interval formed with the second color. The color shift between the first and second colors is determined by detecting the reflection intensities of the first and second patches, and the reading starting position is corrected to a prescribed reference position.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
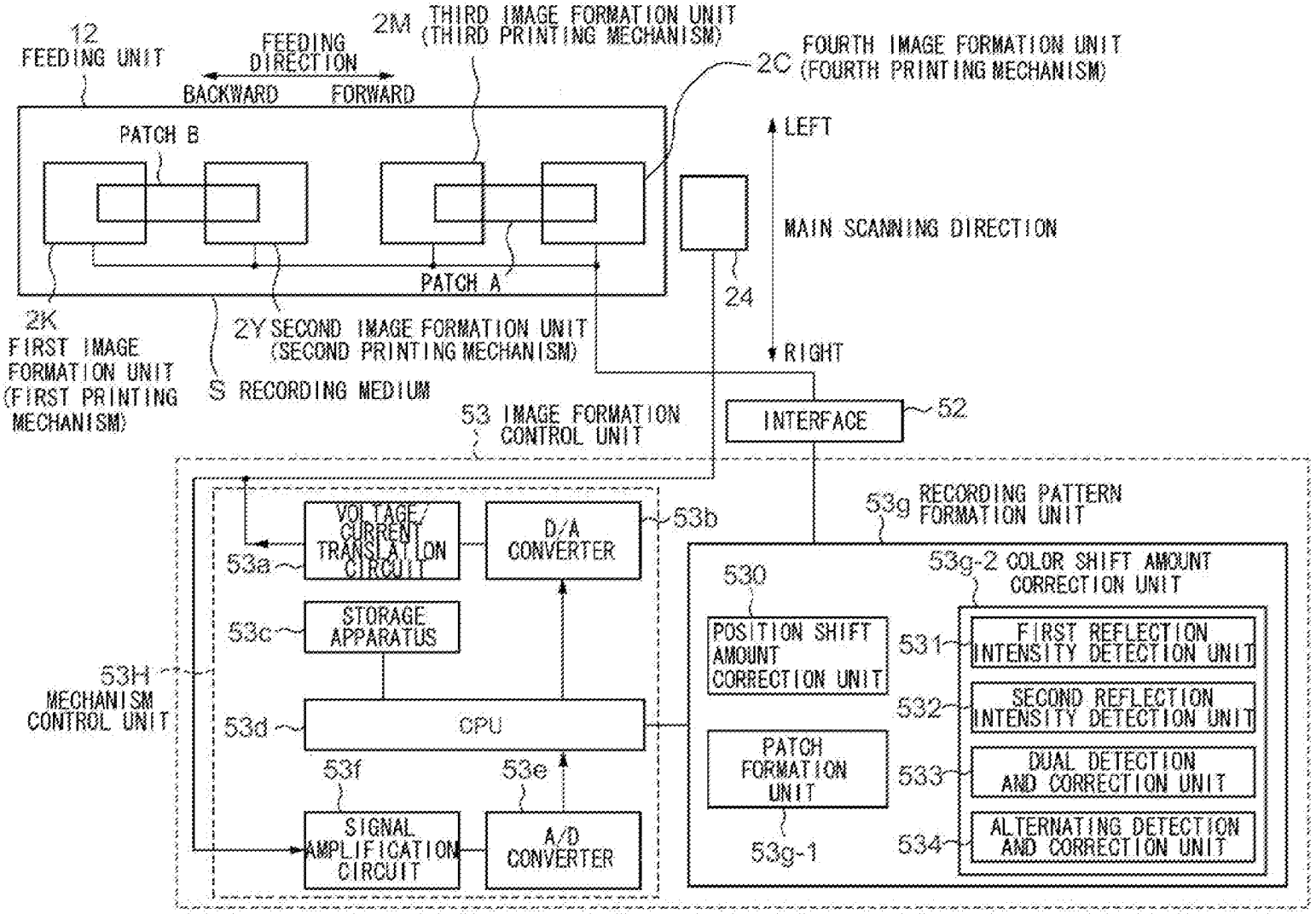
FIG. 1 is a diagram showing the structure around an image formation control unit of the image recording apparatus relating to first through third embodiments of the present invention.

Particular embodiments according to this invention is hereinafter described in detail with reference to the figures.

First Embodiment

The following is a detailed explanation referencing diagrams concerning the first through third embodiments of the present invention. FIGS. 1 through 10 are diagrams showing a color shift detection process of an image recording apparatus 1 according to the first through third embodiments of the present invention.

The image recording apparatus 1 records multiple different color images of a first through fourth image (black (K), yellow (Y), magenta (M), cyan (C)) 2K~2C to a color image conveyance medium such as, e.g., a recording medium S, from a prescribed reference position. The image recording apparatus 1 contains a feeding unit 12 that feeds the color image conveyance medium along a feeding path to the prescribed reference position, multiple image forming units 2K~2C that form the image by copying the multiple different color images to the color image conveyance medium as recording patterns, the reflection intensity detection unit 24 that detects reflection intensities of the multiple patterns copied onto the color image conveyance medium, and an image formation control unit 53 connected to the multiple image forming units via an LED head interface 52. The reflection intensity detection unit 24 has a light emitting unit formed with a LED and the like and a light receiving unit formed with a CCD (Charge Coupled Device) image sensor and the like. The light emitting unit emits light to a color image conveyance medium having color images thereon, such as, e.g., the recording medium S and a conveyance belt 14. The light receiving unit detects a reflection intensity of a light reflected by the color images on the color image conveyance medium. In the figures, the fourth image forming unit 2K forms the color having the smallest degree of light reflection. The first image forming unit 2C forms the color having the largest degree of light reflection during the color shift detection process for detecting the reflection intensity performed by the reflection intensity detection unit 24 is positioned downstream in the feeding path. It may also be possible to configure the image recording apparatus 1 to arrange 2K in place of the first image forming unit 2C located in the downstream so that the first image forming unit 2K has the smallest degree of reflection intensity during the detection process.

The image formation control unit 53 contains a recording pattern formation unit 53*g* and a mechanism control unit 53H around the CPU 53*d*. During calibration, under the control of the CPU 53*d*, the mechanism control unit 53H provides an input signal as feedback, based on an output signal from the reflection intensity detection unit 24 via a signal amplification circuit 53*f* and an A/D converter 53*e*, back to the reflection intensity detection unit 24 via a D/A converter 53*b* and a voltage/current conversion circuit 53*a*. The calibration is performed by reading a patch A and a patch B indicating an amount of color shift while repeating such feedback under the control of the CPU 53*d*.

The recording pattern formation unit 53*g* contains a patch formation unit 53*g*-1 that forms a first patch made up of a first pattern of a first interval with a first color and a second pattern of a second interval with a second color formed overlapping the first pattern, and also forms a second patch made up of a third pattern of the second interval with the first color and a fourth pattern of the first interval with the second color formed overlapping the third pattern. The recording pattern formation unit 53*g* also contains a color shift amount correction unit 53*g*-2 that calculates a color shift amount between the first color and the second color by detecting the reflection intensity of the two patches and executes a color shift correction process, and further contains a position shift amount correction unit 530 that calculates a position shift amount based on the color shift amount and corrects the prescribed reference position.

Figure 5:
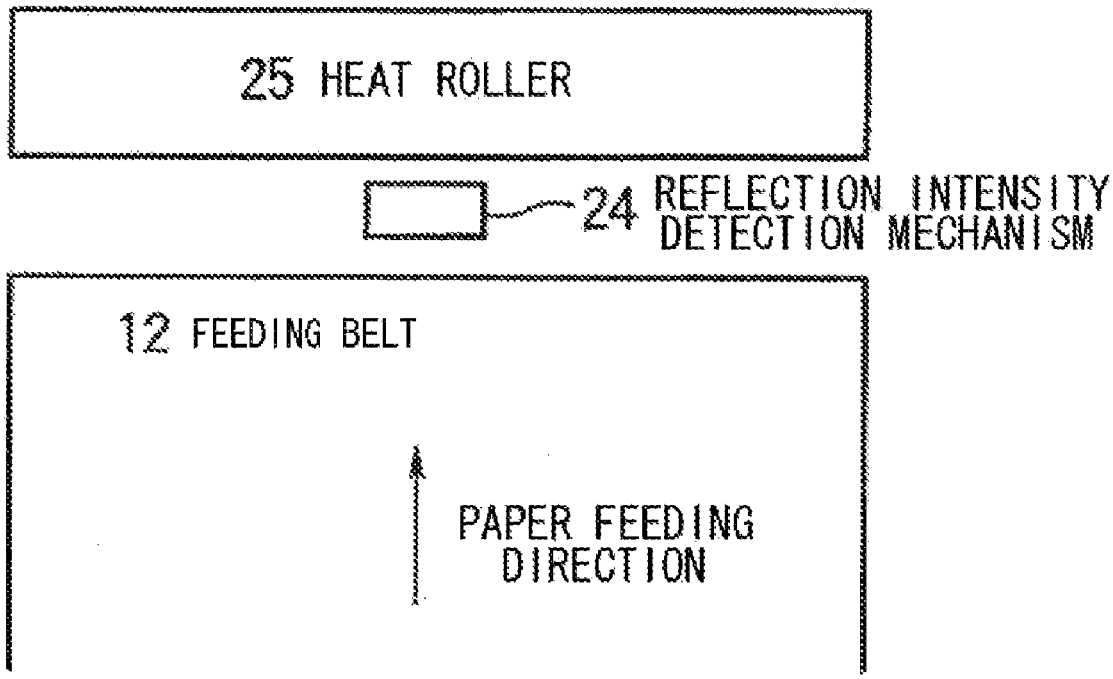
FIG. 5 is a diagram showing surroundings of a reflection intensity detection unit of FIG. 1.
Figure 6:
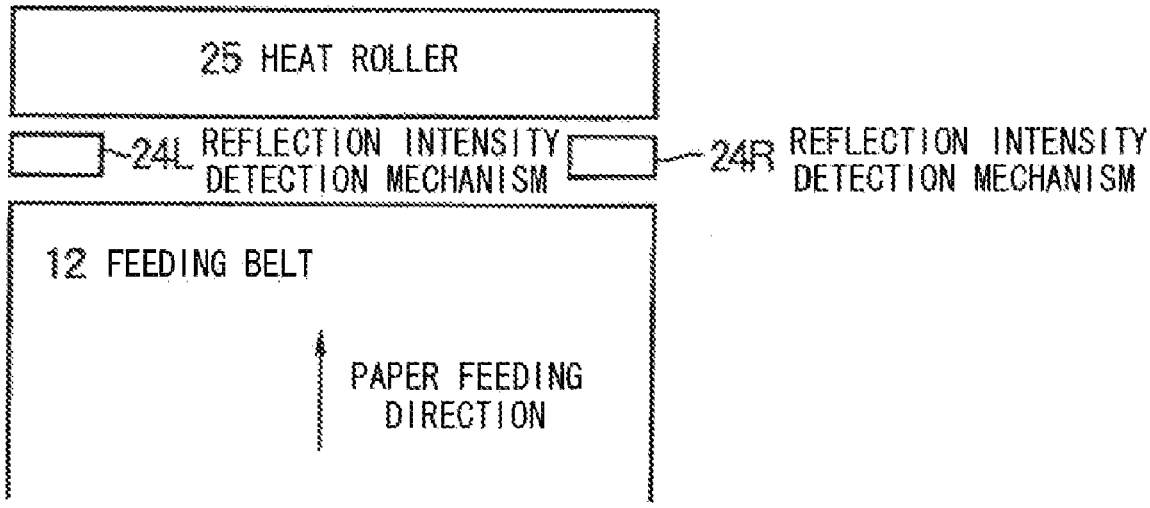
FIG. 6 is a reflection intensity detection unit different from that shown in FIG. 5.
Figure 7:
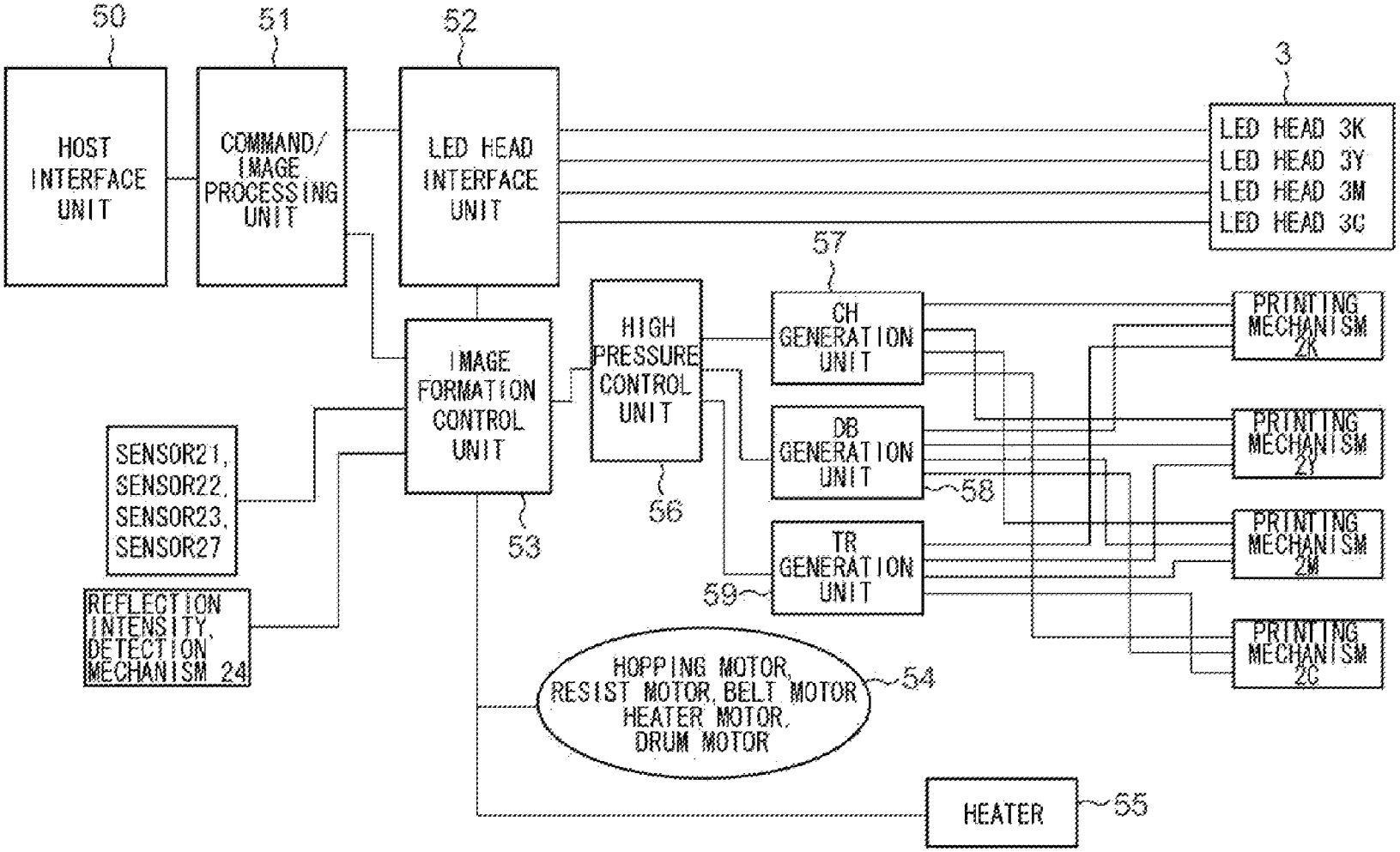
FIG. 7 is a diagram showing the detailed structure of FIG. 1.

FIG. 5 and FIG. 6 shows the arrangement of the reflection intensity detection unit 24. The reflection intensity detection unit 24 is arranged along the feeding path and faces a conveyance belt 12. In FIG. 5, a single piece of the reflection intensity detection unit 24 is arranged facing the center of the conveyance belt 12, however, two reflection intensity detection units 24L and 24R can also be arranged facing the both end portions of the conveyance belt 24 as shown in FIG. 6.

The color shift amount correction unit 53*g*-2 contains a first reflection intensity detection unit 531 that detects the reflection intensity of the first patch and a second reflection intensity detection unit 532 that detects the reflection intensity of the second patch, as the color shift detection unit of multiple patches, namely the first patch (the patch A) and the second patch (the patch B). The color shift amount correction unit 53*g*-2 contains a dual detection and correction unit 533 that executes the detection process for the first and second patches, calculates the amount of color shift of the first and second colors in each case, and performs the color shift adjustment process, namely, adjusting based on the amount of color shift a time difference between the image formation at the first image forming unit and the image formation at the second image forming unit. In addition, an alternating detection and correction unit 534, shown in FIG. 1, will be described later in the third embodiment.

Figure 2:
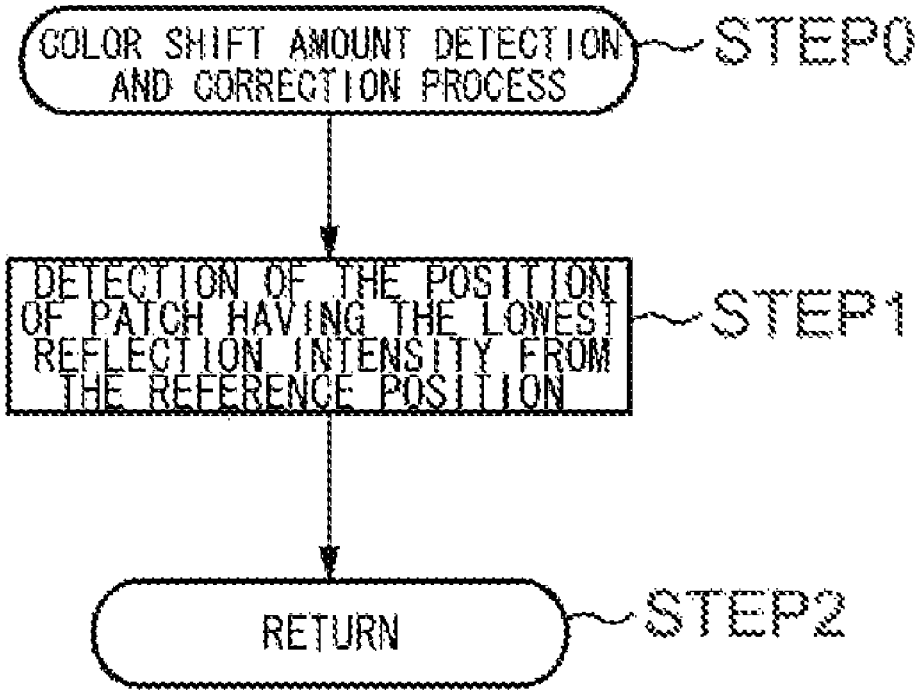
FIG. 2 is a flow chart showing a process of a color shift amount correction unit of FIG. 1.
Figure 3:
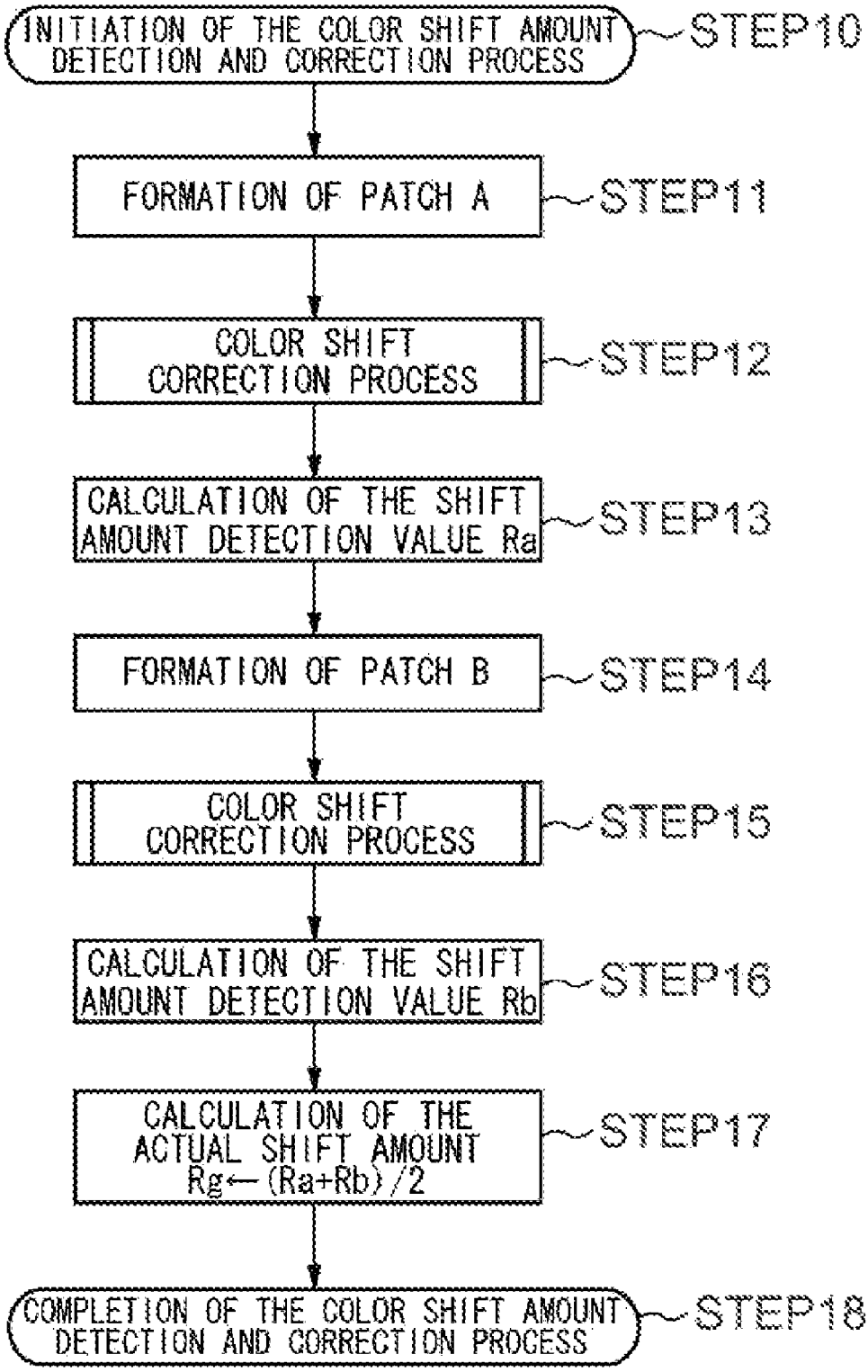
FIG. 3 is a flow chart showing the detailed process of FIG. 2.
Figure 4:
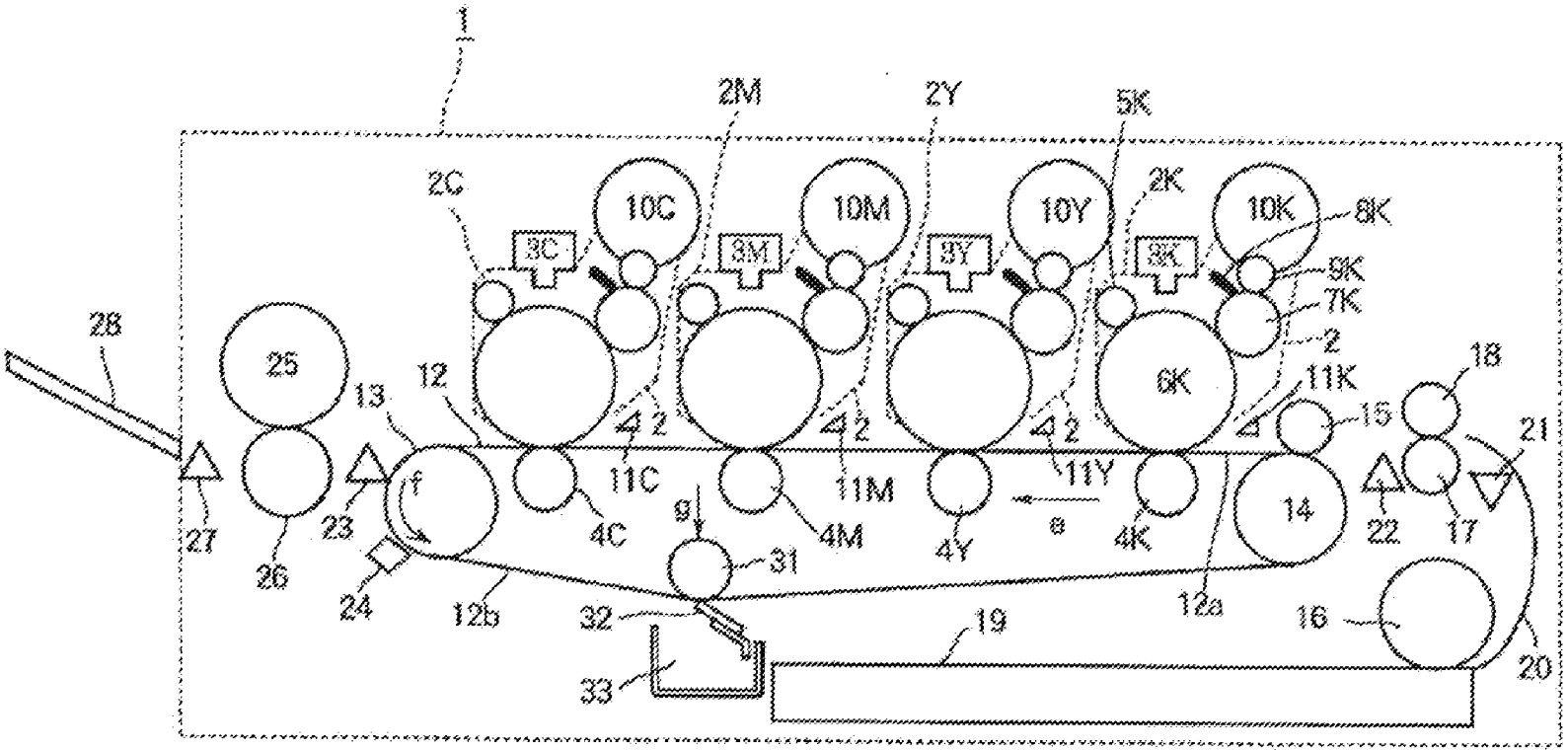
FIG. 4 is an explanatory diagram showing the overall structure of the image recording apparatus of FIG. 1.

As shown in STEP 0~STEP 2 of FIG. 2 and STEP 10~STEP 18 of FIG. 3, in the first embodiment, the performance of the color shift amount correction unit 53*g*-2 requires the color shift amount detection process for the patch A and the color shift detection and correction process for the patch B.

Figure 8:
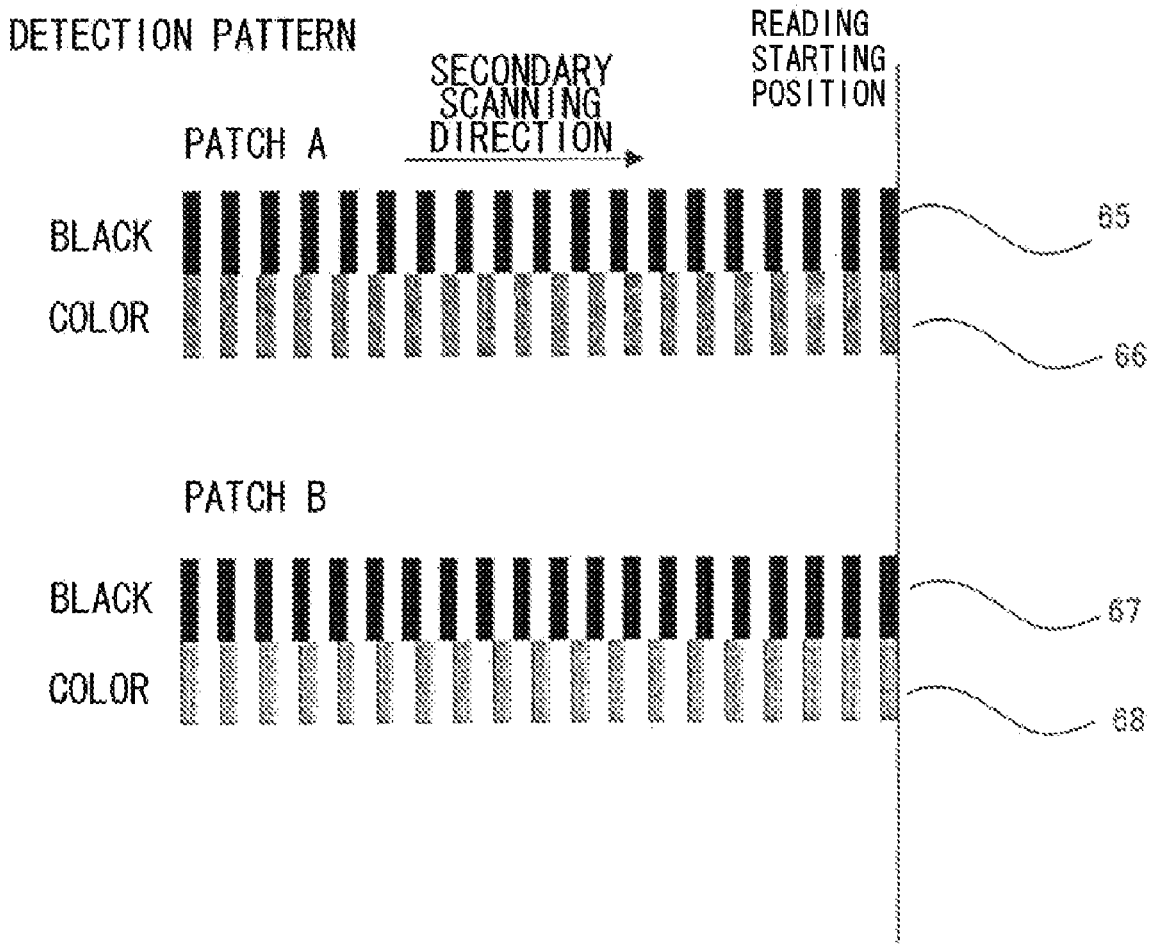
FIG. 8 is an explanatory diagram showing a formation of a patch A and a patch B.

As shown in FIG. 8, the color shift amount correction unit 53*g*-2 in the image recording apparatus forms the patch A in which the intervals of the color pattern pitch (66) are shorter than the intervals of the black pattern pitch (65), and forms the patch B in which the intervals of the color pattern pitch (68) are longer than the intervals of the black pattern pitch (67). The patch A and the patch B are transferred to the color image conveyance medium conveyed by the feeding unit 12 and the amount of color shift is detected. The reflection intensity detection unit 24 detects the time from when reading starts at the reference position to when the portion having the lowest reflection intensity is detected.

Figure 13:
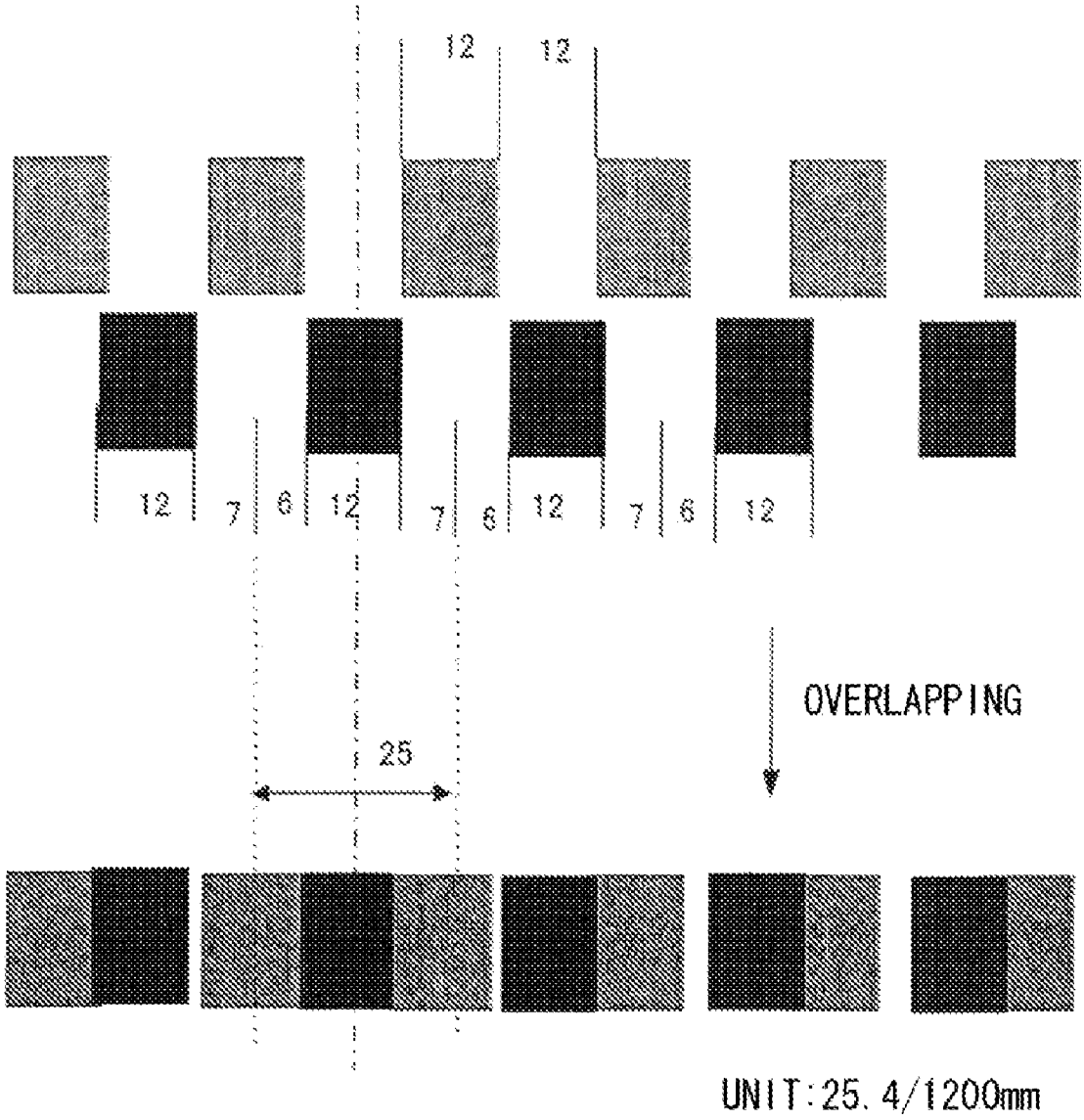
FIG. 13 is a diagram showing a short length of the patch of the present invention.
Figure 18:
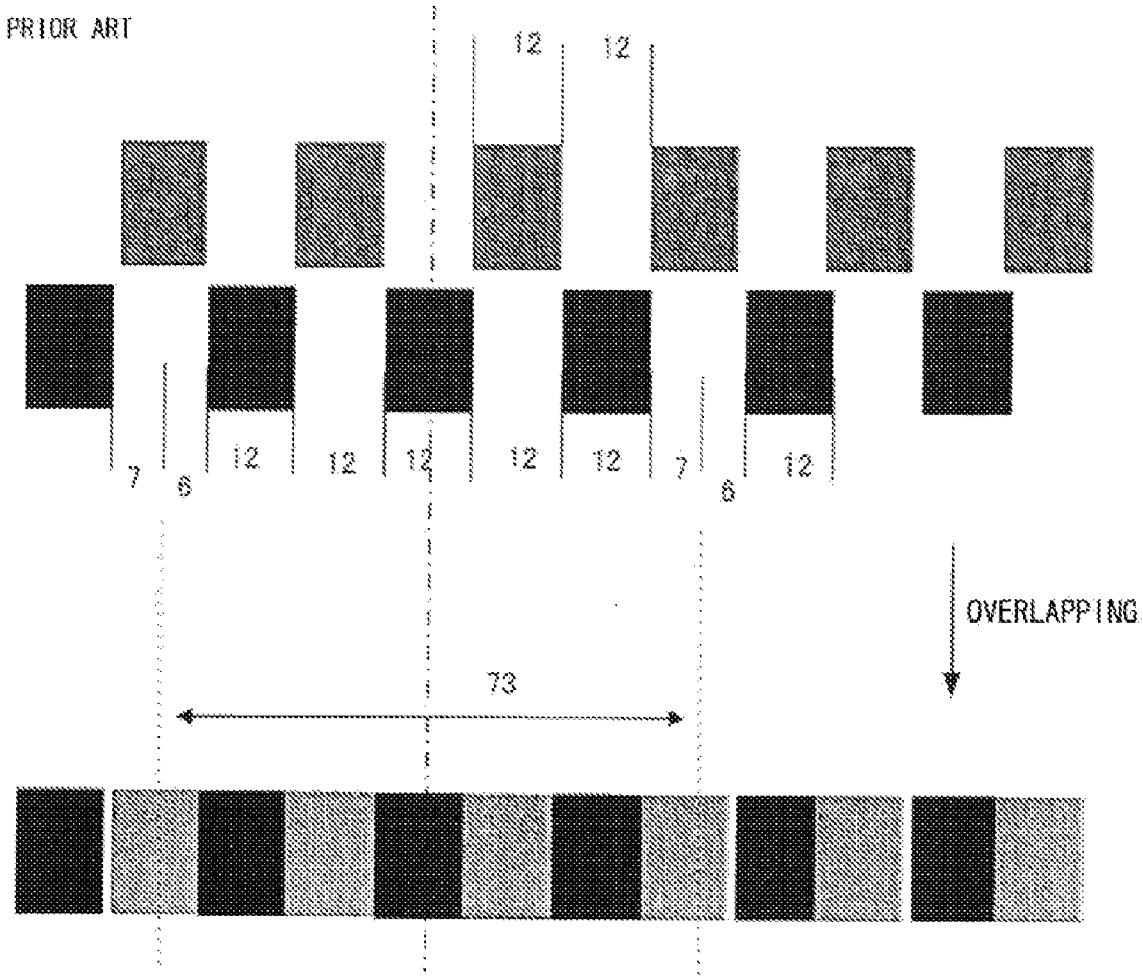
FIG. 18 is a diagram showing a long length of the prior art patch.

As shown in FIG. 13, according to the first embodiment, the length of the patch having patterns shifted by a certain amount is shortened from the 73 mm in FIG. 18 to the 25 mm in FIG. 13, which is approximately ⅓ shorter than conventional lengths.

Figure 10:
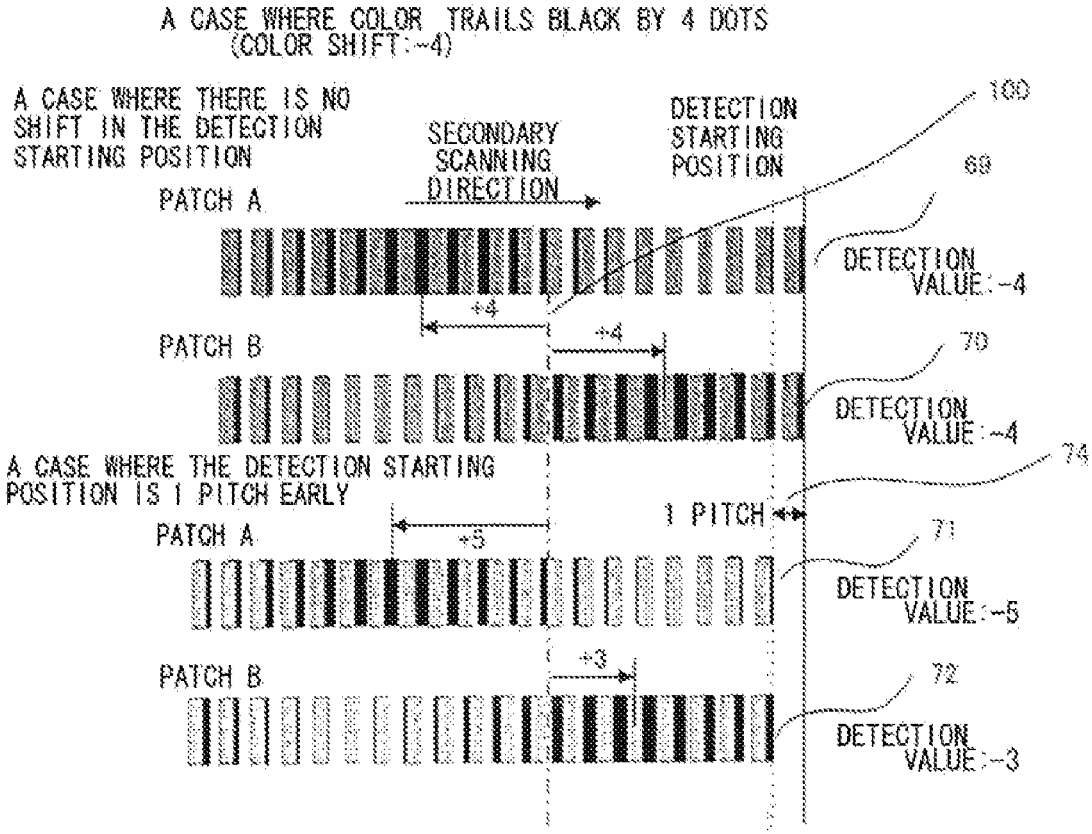
FIG. 10 is a flow chart showing an initial color shift detection process of the color shift amount correction section according to a second embodiment of the present invention.

FIG. 10 shows the patch A and the patch B according to the first embodiment in a case where there is no amount of color shift and a case where there is an amount of color shift. A dot and dash line 100 is the location at which the reflection intensity detection unit 24 should detect the portion of the patch having the lowest reflection intensity where there is no shift in the reading starting position of the reflection intensity detection unit 24 from the reference position and no color shift between the black and color recording heads. A pattern 69 and a pattern 70 are examples of a case where the shift between the black and color recording heads is "+4" and there is no shift in the reading starting position of the reflection intensity detection unit 24. In a case of the color shift detected with the patch A, the reflection intensity detection unit 24 detects the time from the beginning of detection to the portion lagging four pitches behind the reference line of the pattern, i.e., the dot and dash line 100. In FIG. 10, one pitch is 25.4/1200 dpi. In a case of the color shift detected with the patch B, the reflection intensity detection unit 24 detects the time from the beginning of detection to the portion four pitches ahead of the reference line of the pattern, i.e., the dot and dash line 100.

Patterns 7 land 72 of FIG. 10 show a case where there is a shift in the reading starting position of the reflection intensity detection unit 24, that is, the reading starting position of the leading edge of the patch A and the patch B for color shift detection process is behind the reference position by one pitch in the pattern. In a case of the color shift is detected with the patch A, the reflection intensity detection unit 24 detects the time from the beginning of detection to the portion lagging five pitches behind the reference line of the pattern, i.e., the dot and dash line 100, and the detected value is −5. In a case of the color shift is detected in the patch B, the reflection intensity detection unit 24 detects the time from the beginning of detection to the portion occurring three pitches ahead of the reference line of the pattern, i.e., the dot and dash line 100, and the detected value is −3.

Where there is no shift in the reading starting position of the reflection intensity detection unit 24 from the reference position, the amount of color shift detected in the patch A is equal to the amount of color shift detected in the patch B. In a case where there is a shift in the reading starting position of the reflection intensity detection unit 24 from the reference position, the amount of color shift detected in the patch A is set to Ra, the amount of color shift detected in the patch B is set to Rb, and both Ra and Rb include the amount of shift in the reading starting position of the reflection intensity detection unit 24 from the reference position, but the actual amount of color shift Rg is calculated from the following equation:

$$Rg=(Ra+Rb)/2 \qquad \text{Equation (1)}$$

In the example of FIG. 10, an actual color shift amount of −4 is calculated from Ra of −5 and Rb of −3. By correcting the amount of color shift using the equation (1) at the time of printing, the amount of color shift can be accurately measured without adversely affected by the shift in the reading starting position of the reflection intensity detection unit 24 from the reference position.

FIG. 2 and FIG. 3 show flowcharts of the color shift amount detection process.

Each length of the patch A and the patch B is ⅓ of the conventional patch length, but the total patch length can be shrunk to ⅔ of the conventional patch length because the color shift detection process must be performed for both the patch A and the patch B in a single color shift correction operation.

In the manner described above, the image recording apparatus having minimal color shift can be realized by accurately measuring and correcting the amount of color shift without being adversely affected by the error, i.e., shift, in the reading starting position of the reflection intensity detection unit 24 from the reference position. Conventionally, it was necessary to arrange repeating patches having the same pitch and set the length of the patch equal to or more than the amount of shift in the reading starting position to avoid the adverse affect of the shift in the reading starting position, but the present invention can shrink the length of the repeating patch and therefore decrease the length of the overall length of the patch for color shift detection process to approximately ⅔ of that of conventional patches.

Second Embodiment

Figure 11:
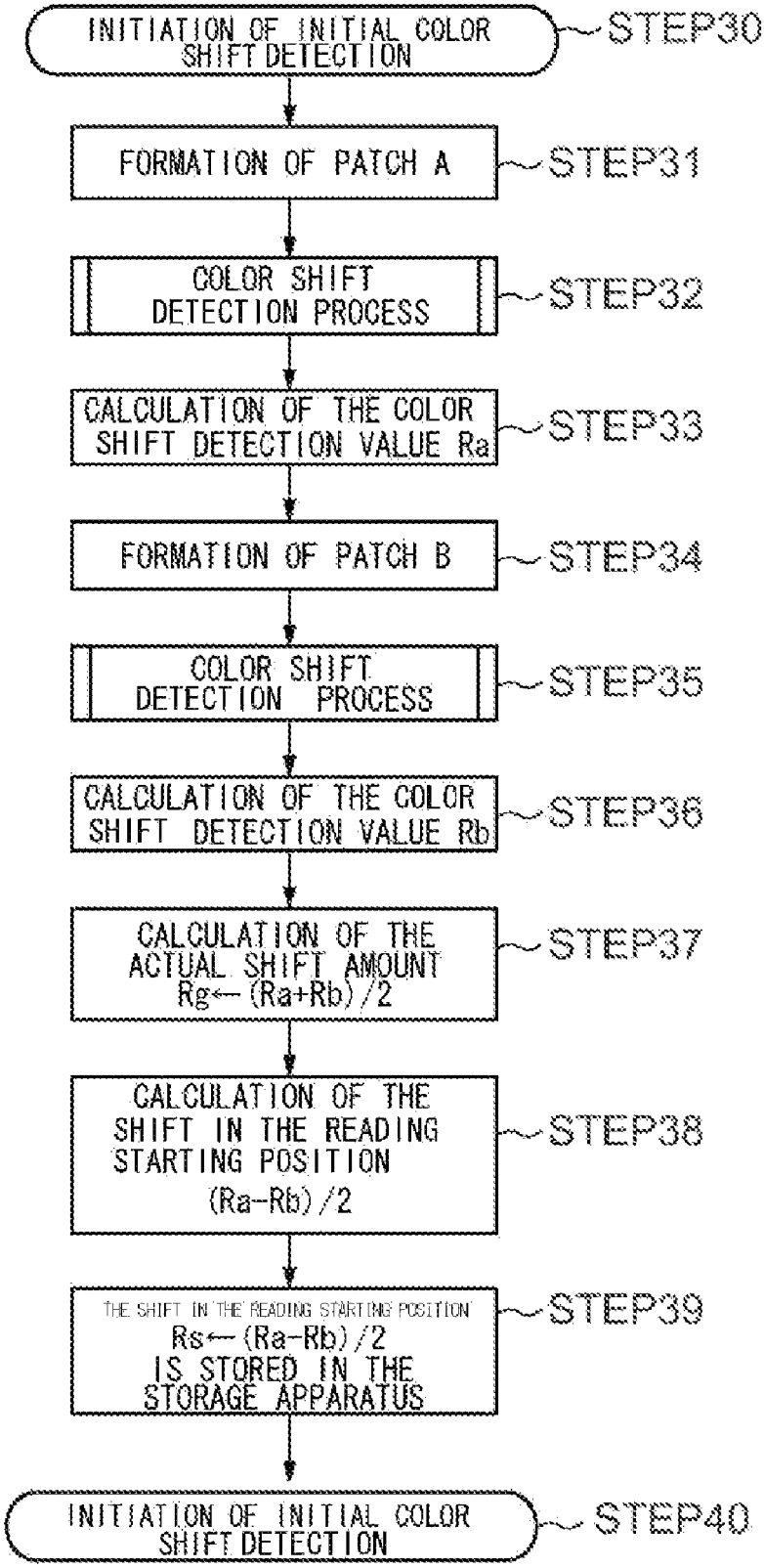
FIG. 11 is a flow chart showing the initial color shift detection process according to the second embodiment.
Figure 12:
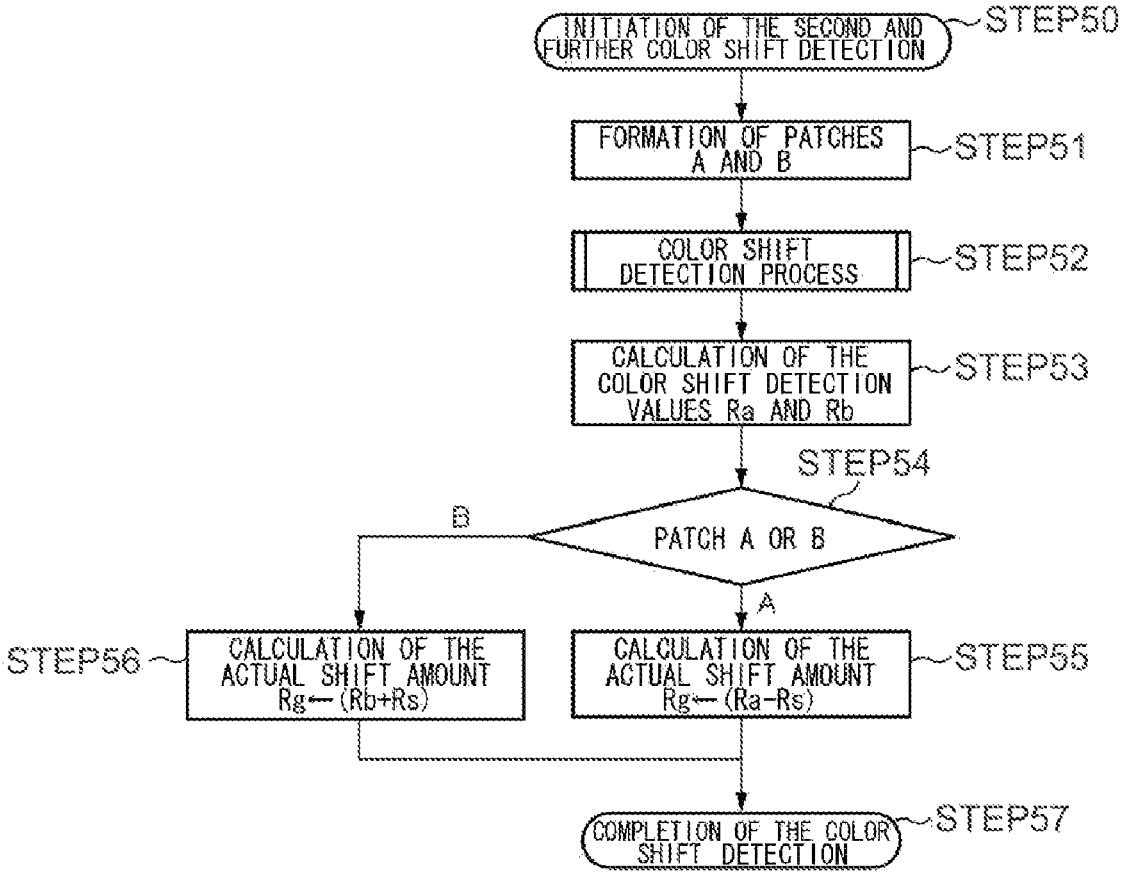
FIG. 12 is a flow chart showing the color shift detection process after the second execution according to the second embodiment.

The following is a detailed explanation referencing diagrams concerning the second embodiment of the present invention. FIG. 11 and FIG. 12 show flowcharts according to the second embodiment.

The detection of the amount of color shift, the circuit structure, and the structure for detecting the amount of color shift with the patches A and B are the same as those of the first embodiment.

In the first embodiment, only the actual amount of color shift Rg is calculated from the color shift detection values Ra and Rb detected with the patches A and B generated by the first reflection intensity detection unit 531 and the second reflection intensity detection unit 532. In the second embodiment, however, the amount of shift in detection starting time, that is, shift in reading starting position, of the reflection intensity detection unit 24 is calculated from Ra and Rb, and there is a difference in the detection process (from STEP 37 to STEP 39) relating to the calculation of the amount of actual color shift. Therefore, the calculated result of the shift in detection starting time is stored in a storage apparatus 53*c* shown in FIG. 1.

FIG. 11 and FIG. 12 are flowcharts showing the color shift detection process according to the second embodiment. The color shift detection process according to the second embodiment is the same as that of the first embodiment until STEP 37 of process 75.

FIG. 10 shows an example of the color shift detection process of the second embodiment. In the same manner as the first embodiment, in a case where there is a shift in reading starting position of the reflection intensity detection unit 24 from the reference position, the amount of color shift detected with the patch A is set to Ra, the amount of color shift detected with the patch B is set to Rb, and both Ra and Rb include the amount of shift in the reading starting position of the reflection intensity detection unit 24, and the amount Rs of shift in the reading starting position is calculated with the following equation:

$$Rs=(Ra-Rb)/2 \qquad \text{Equation (2)}$$

Figure 9:
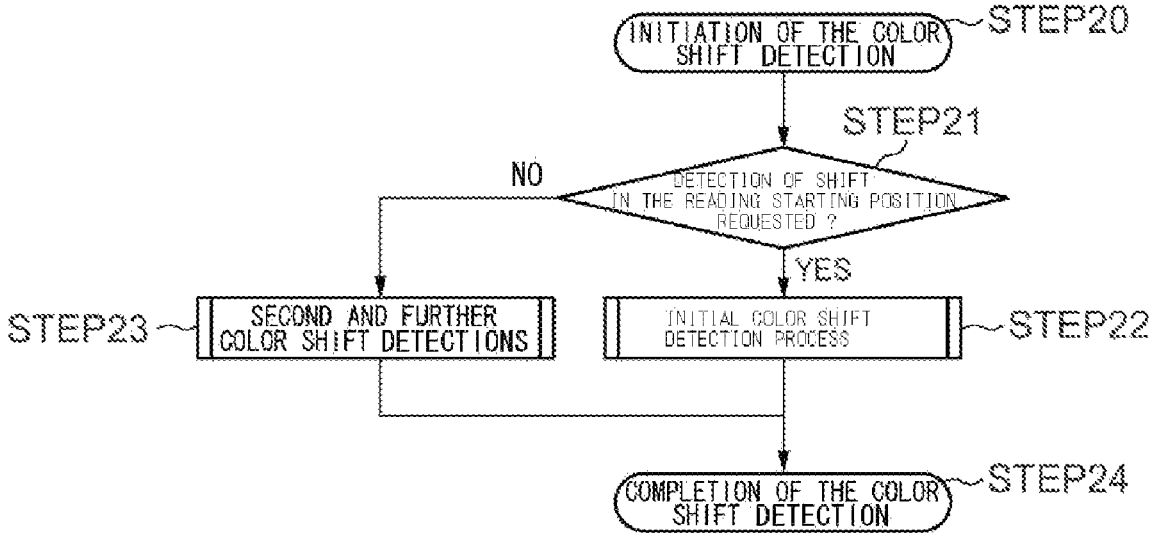
FIG. 9 is a flow chart showing the color shift detection process according to the second embodiment of this invention.

The actual color shift detection amount Rg is calculated in the same manner as the first embodiment using the equation 1. FIG. 11 and FIG. 12 show the detection of the amount of shift in the reading starting position and the calculation of the amount of color shift. The detection of the amount of shift in the reading starting position is performed once only at the start of the color shift detection operation as shown in FIG. 9. In and after the second color shift detection process, only the amount of color shift is detected using either only the patch A or only the patch B, and the color shift detection value Rg is corrected using the amount Rs of shift in the reading starting position calculated from the equation 2. That is, the corrected color shift detection value Rg is calculated with an equation Rg=Ra−Rs in a case where the color shift is detected with the patch A, and with Rg=Rb+Rs in a case where the color shift is detected with the patch B.

In and after the second color shift detection process, the detection of the amount of shift in the reading starting position (an initial color shift detection) is performed again in cases where the value of Rs is expected to be changed, such as, e.g., at the time of replacement of the transfer belt unit 12*a* or replacement of the photosensitive drum unit.

In addition to the advantages of the first embodiment, the image recording apparatus according to the second embodiment is advantageous in shrinking the length of the patch to approximately ⅓ of the length of the conventional patch when only the amount of color shift is detected (when the initial color shift detection is not performed). Because the initial color shift detection, namely, the detection and recordation of the shift in the reading starting position calculated from the result of color shift detection with both the patch A and the patch B, is performed only when there is a possibility that the shift in the reading starting position may occur, such as, e.g., at the time of a shipment from factory or right after the replacement of the photosensitive drum unit or the transfer belt unit, and in the subsequent color shift detection processes, only the color shift detection using either only the patch A or only the patch B is performed and the amount of color shift is corrected using the result of the amount of shift in the reading starting position detected in the initial color shift detection.

Third Embodiment

Figure 14:
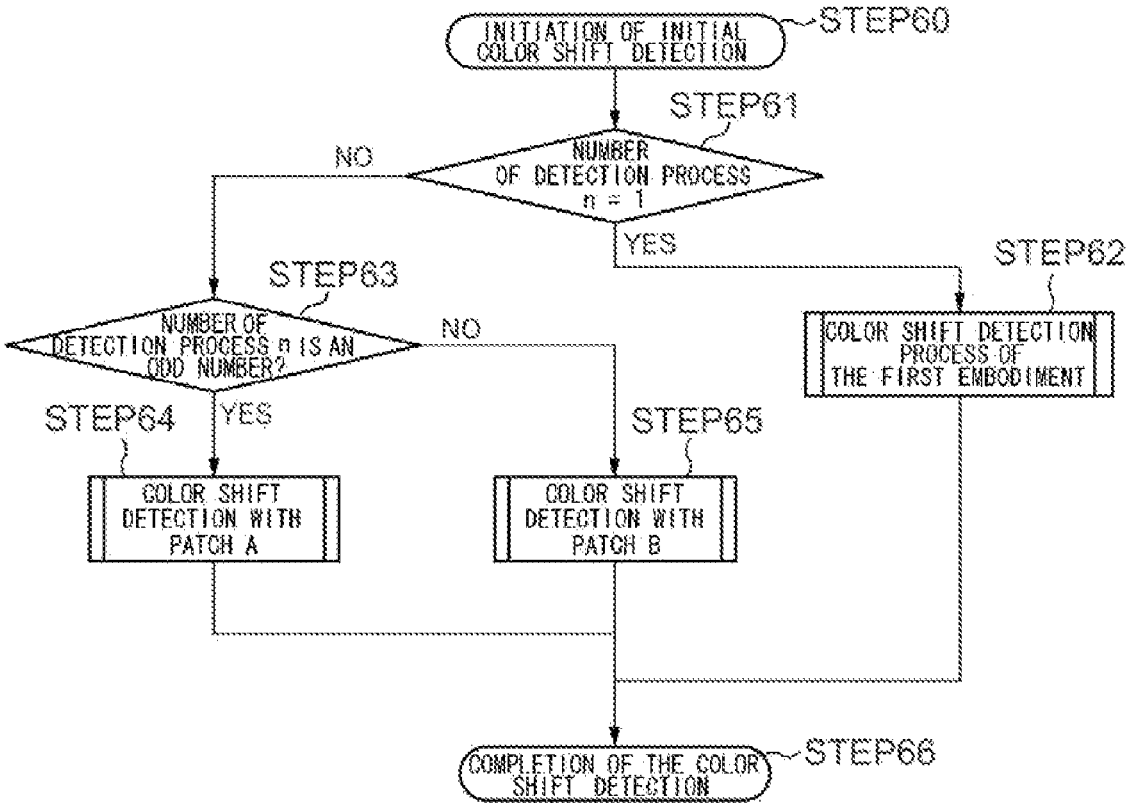
FIG. 14 is a flow chart showing the process of the image recording apparatus according to the third embodiment of the present invention.
Figure 15:
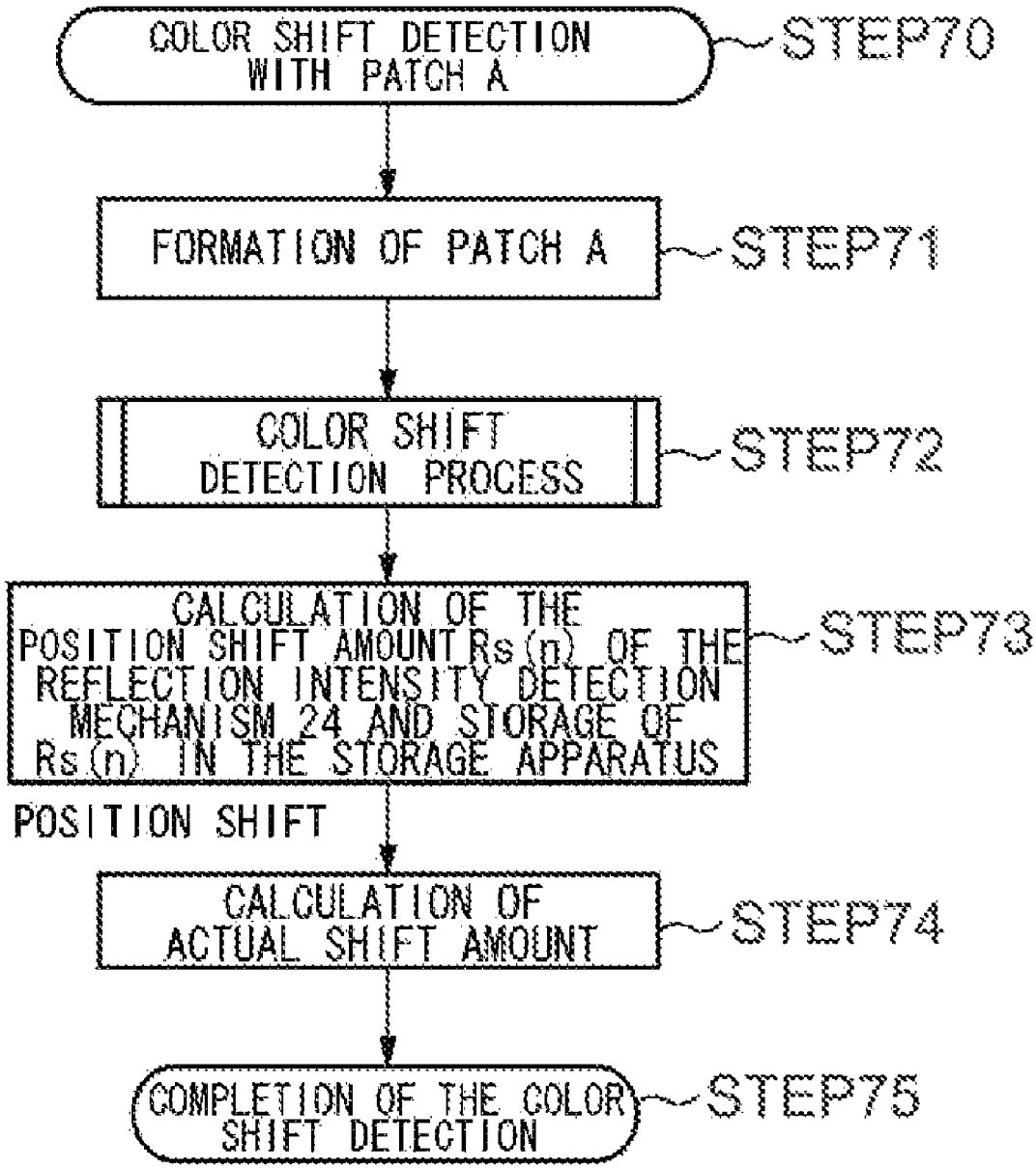
FIG. 15 is a flow chart showing the color shift detection process using a patch A according to the third embodiment of this invention.
Figure 16:
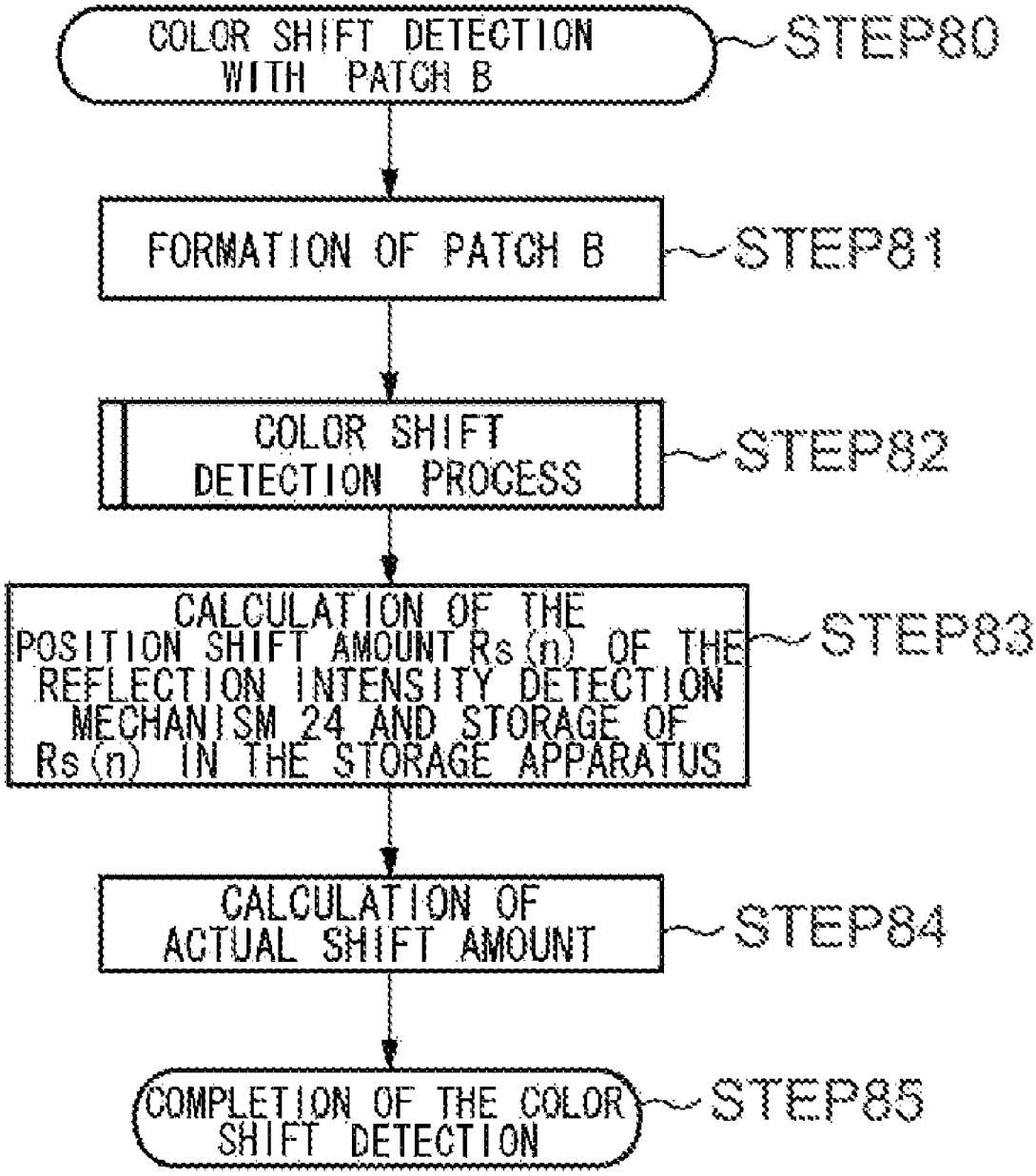
FIG. 16 is a flow chart showing the color shift detection process using a patch B according to the third embodiment of this invention.

The following is a detailed explanation referencing diagrams concerning the third embodiment of the present invention. FIG. 14 through FIG. 16 show flowcharts according to the third embodiment.

The detection of the amount of color shift, the circuit structure, and the structure for detecting the amount of color shift in the patches A and B are the same as those of the first embodiment.

The third embodiment is structured in such a manner such that, in place of the dual detection and correction unit 533, there is an alternating detection and correction unit 534 correcting the color shift detection value by alternately executing color shift detection with the patch A and the patch B and calculating the amount of shift in the reading starting position of the reflection intensity detection unit 24 from the reference position.

Figure 17:
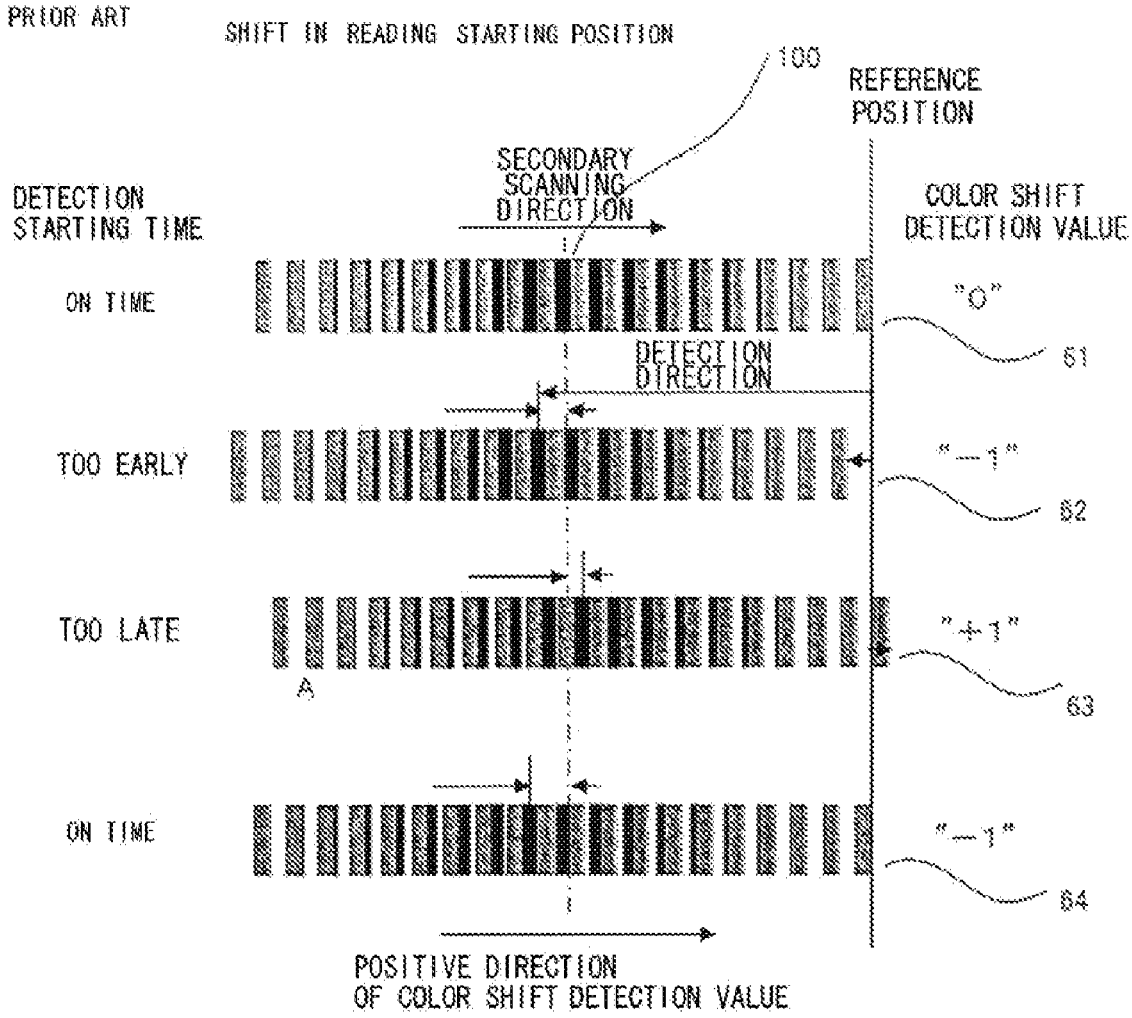
FIG. 17 is a diagram showing prior art detection patterns.

STEP 60~STEP 66, STEP 70~STEP 75, and STEP 80~STEP 85, shown in FIG. 16 through FIG. 18, show flowcharts of the color shift detection process according to the third embodiment. The method for calculating the amount of color shift with the patches A and B and for calculating the amount of shift in the reading starting position of the reflection intensity detection unit 24 is the same as that of the second embodiment with respect to only the initial color shift detection. In the color shift detection processes in and after the second detection, the color shift detection value is corrected by alternately executing color shift detection with the patch A and the patch B and calculating the amount of shift in the reading starting position of the reflection intensity detection unit 24. The color shift detection value with the patch A in the initial color shift detection is Rg(1) and the color shift detection value with the patch B in the second color shift detection is Rg(2). The color shift detection process with either the patch A or the patch B is expressed as one unit, and the color shift detection value is expressed as Rg(n) where n=1, 2, 3, . . . corresponding to the number of times the color shift detection operation is executed. The calculated value of the amount of shift in the reading starting position of the reflection intensity detection unit 24 in and after the second color shift detection is expressed as Rs(n). In the third embodiment, the color shift detection is executed with the patch A in a case where n is an odd number as shown in FIG. 15, and the color shift detection is executed with the patch B in a case where n is an even number as shown in FIG. 16.

In the first color shift calculation, in the same manner as shown in FIG. 11 and FIG. 12 of the second embodiment, the corrected color shift detection value Rg and the amount Rs of shift in the reading starting position are calculated as follows.

$$(n=1, 2)$$

$$Rs(2)=(Rg(1)-Rg(2))/2$$

$$Rg(2)=(Rg(1)+Rg(2))/2$$

The color shift adjustment process is performed based on the corrected color shift value Rg(2).

In the third color shift detection process, the color shift detection is executed with patch A. The color shift detection value detected with the patch B in the second color shift detection (when n=2) can be calculated by Rg(2)−Rs(2) in which the amount of shift is subtracted from the corrected color shift value Rg(2).

$$Rs(3)=(Rg(3)-(Rg(2)-Rs(2)))/2$$

$$Rg(3)=(Rg(3)+(Rg(2)-Rs(2)))/2$$

The color shift adjustment process is performed based on the corrected color shift value Rg(3).

Further, in the fourth color shift detection operation, the color shift detection is executed with patch B. The color shift detection value detected with the patch A in the third color shift detection (when n=3) can be calculated by Rg(3)+Rs(3) in which the amount of shift is added to the corrected color shift value Rg(3).

$$Rs(4)=((Rg(3)+Rs(3))-Rs(4))/2$$

$$Rg(4)=((Rg(3)+Rs(3))+Rs(4))/2$$

The color shift correction process is performed based on the corrected color shift value Rg(4). Therefore, when n=3, 4, 5, 6, . . . , Rs(n) and R(g) can be expressed as follows. In a case where the color shift detection is executed with the patch A (n=3, 5, 7, 9, . . . ):

$$Rs(n)=(Rg(n)-(Rg(n-1)-Rs(n-1)))/2$$

$$Rg(n)=(Rg(n)+(Rg(n-1)-Rs(n-1)))/2$$

In a case where the color shift detection is executed with the patch B (n=4, 6, 8, 10, . . . ):

$$Rs(n)=((Rg(n-1)+Rs(n-1))-Rg(n))/2$$

$$Rg(n)=((Rg(n-1)+Rs(n-1))+Rg(n))/2$$

By calculating the amount of shift in the reading starting position of the reflection intensity detection unit 24 and correcting the color shift detection value while alternately performing the color shift detection operation with either the patch A or the patch B, a color shift detection error caused by a shift in the reading starting position of the reflection intensity detection unit 24 can be reduced.

According to the third embodiment, the overall length of the patch used in the normal color shift detection process can be reduced to ⅓ of the length of the conventional patch in the same manner as the second embodiment. In addition, by alternately executing the color shift detection operation with either the patch A or the patch B and calculating the amount of shift in the reading starting position of the reflection intensity detection unit 24 to correct the color shift detection value, the color shift detection value is not adversely affected by a change in speed of the transfer belt due to aging, and the precision of the color shift detection can be maintained, thus making it possible to print with a low amount of the color shift.

In the embodiments described above, the patch A and the patch B are printed on the color image conveyance medium, namely, the recording medium S, used as the reference position. However, the patch A and the patch B can also be printed on the conveyance belt, instead of the recording medium S, used as the reference position. That is, the patch A and the patch B can be printed on the conveyance belt, instead of the recording medium S, at a time when the conveyance belt is conveyed for a certain distance from a prescribed position or from when a color shift adjustment process is instructed so that the image recording apparatus can obtain the color shift value by reading with the reflection intensity detection unit 24 the reflection intensity of the patch A and the patch B on the conveyance belt in a same manner as described in the above embodiments.

In the embodiments described above, a direct transfer image recording apparatus is described that directly transfers a toner latent image to the recording medium, namely the printing medium. However, this invention can also be applied to a indirect transfer image recording device that transfers the toner latent image to the transfer belt and then transfers the toner latent image on the transfer belt later all at once. Further, the present invention can also be used in a copy machine, a fax machine, or an MFP apparatus that forms an image by overlapping two or more colors.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. An image recording apparatus for recording a pattern to a color image conveyance medium and reading said recorded pattern, the image recording apparatus comprising:

a feeding unit that feeds said color image conveyance medium along a feeding path;

a first image forming unit that records a pattern to said color image conveyance medium in a first color;

a second image forming unit that records a pattern to said color image conveyance medium in a second color;

a reflection intensity detection unit that reads a reflection intensity of said patterns; and an image formation control unit for calculating from said reflection intensity a color shift value of said second image forming unit with respect to said first image forming unit, wherein said first image forming unit records a first pattern of a first interval and said second image forming unit records a second pattern of a second interval overlapping said first pattern so that a first patch having said first pattern and said second pattern overlapped is formed, and wherein said first image forming unit records a third pattern of said second interval and said second image forming unit records a fourth pattern of said first interval overlapping said third pattern so that a second patch having said third pattern and said fourth pattern overlapped is formed.

2. The image recording apparatus according to claim 1, wherein said reflection intensity detection unit reads a reflection intensity of said first patch and a reflection intensity of said second patch, wherein said image formation control unit calculates said color shift value from said reflection intensity of said first patch and said reflection intensity of said second patch and then performs a color shift adjustment process based on said color shift value calculated.

3. The image recording apparatus according to claim 1, wherein said reflection intensity detection unit reads from a reading starting position a reflection intensity of said first patch and a reflection intensity of said second patch, wherein said image formation control unit calculates, from said reflection intensity of said first patch and said reflection intensity of said second patch, said color shift value corrected so as not to include a position shift value between a reference position and said reading starting position and then said image formation control unit performs a color shift adjustment process based on said color shift value calculated and corrected.

4. The image recording apparatus according to claim 1, wherein said first image forming unit is arranged upstream of said second image forming unit along said feeding path, wherein a reflective index of said first color is lower than a reflective index of said second color, and wherein said reflection intensity detection unit reads a reflection intensity of said first patch and a reflection intensity of said second patch to detect a portion having the lowest reflection intensity.

5. The image recording apparatus according to claim 1, wherein said first image forming unit is arranged upstream of said second image forming unit along said feeding path, wherein a reflective index of said first color is higher than a reflective index of said second color, and wherein said reflection intensity detection unit reads a reflection intensity of said first patch and a reflection intensity of said second patch to detect a portion having the highest reflection intensity.

6. The image recording apparatus according to claim 1, wherein where it is necessary to calculate a position shift value between a reference position and a reading starting position, said reflection intensity detection unit reads from said reading starting position a reflection intensity of said first patch and a reflection intensity of said second patch, wherein where it is necessary to calculate said position shift value, said image formation control unit calculates said position shift value from said reflection intensity of said first patch and said reflection intensity of said second patch and holds said position shift value calculated, wherein where it is not necessary to calculate said position shift value, said reflection intensity detection unit reads a reflection intensity of one of said first patch or said second patch, and wherein where it is not necessary to calculate said position shift value, said image formation control unit calculates said color shift value from said reflection intensity of the one of said first patch or said second patch and corrects said color shift value using said position shift value so that said color shift value does not include said position shift value and then said image formation control unit performs a color shift adjustment process based on said color shift value calculated and corrected.

7. The image recording apparatus according to claim 1, wherein said reflection intensity detection unit alternately reads a reflection intensity of said first patch and a reflection intensity of said second patch from a reading starting position, wherein said image formation control unit calculates a position shift value between a reference position and said reading starting position and a color shift value corrected so as not to include said position shift value from said position shift value calculated in a previous reading, said color shift value calculated in said previous reading, and one of said reflection intensity of said first patch or said second patch, and wherein said image formation control unit holds said corrected color shift value and said position shift value and performs a color shift adjustment process based on said corrected color shift value.

8. The image recording apparatus according to claim 2, wherein said color shift adjustment process is a process to adjust a time difference between a recording of a first image with said first image forming unit and a recording of a second image with said second image forming unit so that said first image does not shift from said second image.

9. The image recording apparatus according to claim 1, wherein said color image conveyance medium is a recording medium.

10. The image recording apparatus according to claim 1, wherein said color image conveyance medium is a conveyance belt.

* * * * *